US011643901B2

(12) United States Patent
Hrupp

(10) Patent No.: US 11,643,901 B2
(45) **Date of Patent: *May 9, 2023**

(54) UPHOLE END FOR A COMPRESSION-SET STRADDLE PACKER

(71) Applicant: Exacta-Frac Energy Services, Inc., Conroe, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/694,973

(22) Filed: Mar. 15, 2022

(65) Prior Publication Data

US 2022/0195831 A1 Jun. 23, 2022

Related U.S. Application Data

(63) Continuation of application No. 17/101,377, filed on Nov. 23, 2020, now Pat. No. 11,293,255, which is a continuation of application No. 16/289,805, filed on Mar. 1, 2019, now Pat. No. 10,900,320.

(51) Int. Cl.
*E21B 33/128* (2006.01)
*E21B 34/14* (2006.01)

(52) U.S. Cl.
CPC ..... *E21B 33/128* (2013.01); *E21B 34/14* (2013.01); *E21B 2200/06* (2020.05)

(58) Field of Classification Search
CPC .... E21B 19/00; E21B 2200/06; E21B 23/006; E21B 23/01; E21B 23/04; E21B 23/06; E21B 33/12; E21B 33/124; E21B 33/128; E21B 34/14; E21B 37/00; E21B 41/0078; E21B 43/267
See application file for complete search history.

(56) References Cited

U.S. PATENT DOCUMENTS

| | | | | |
|---|---|---|---|---|
| 4,567,944 | A | 2/1986 | Zunkel et al. | |
| 4,590,995 | A | 5/1986 | Evans | |
| 4,962,815 | A | 10/1990 | Schultz et al. | |
| 5,291,947 | A | 3/1994 | Stracke | |
| 6,253,856 | B1 | 7/2001 | Ingram et al. | |
| 6,655,461 | B2 | 12/2003 | Eslinger et al. | |
| 6,666,276 | B1 | 12/2003 | Yokley | |
| 6,883,610 | B2 | 4/2005 | Depiak | |
| 9,291,044 | B2 | 3/2016 | Murphy et al. | |
| 9,598,939 | B2 | 3/2017 | Lee | |
| 10,138,174 | B2 | 11/2018 | Mitchell et al. | |
| 10,822,911 | B2 * | 11/2020 | Hrupp | E21B 33/1246 |
| 10,900,319 | B2 * | 1/2021 | Hrupp | E21B 23/04 |
| 10,900,320 | B2 * | 1/2021 | Hrupp | E21B 33/128 |
| 11,035,189 | B2 * | 6/2021 | Hrupp | E21B 23/06 |
| 11,248,438 | B2 * | 2/2022 | Hrupp | E21B 34/10 |
| 11,293,255 | B2 * | 4/2022 | Hrupp | E21B 43/267 |

(Continued)

*Primary Examiner* — Daniel P Stephenson
(74) *Attorney, Agent, or Firm* — JK Intellectual Property Law, PA

(57) ABSTRACT

An uphole end for a compression-set straddle packer has a multicomponent mandrel and a multicomponent sliding sleeve that reciprocates within a limited range on the multicomponent mandrel. A bias element constantly resists relative movement between the multicomponent mandrel and the multicomponent sliding sleeve.

20 Claims, 6 Drawing Sheets

(56) References Cited

U.S. PATENT DOCUMENTS

| | | | | |
|---|---|---|---|---|
| 2007/0235194 | A1 | 10/2007 | Maier | |
| 2010/0195040 | A1 | 8/2010 | Koganezawa | |
| 2015/0376979 | A1 | 12/2015 | Mitchell et al. | |
| 2016/0376868 | A1* | 12/2016 | Manke | E21B 33/1285 166/387 |
| 2019/0195040 | A1* | 6/2019 | Hrupp | E21B 33/1246 |
| 2019/0377992 | A1* | 12/2019 | Hrupp | G06K 19/0723 |
| 2020/0024916 | A1* | 1/2020 | Andreychuk | E21B 33/1293 |
| 2020/0277835 | A1* | 9/2020 | Hrupp | E21B 33/124 |
| 2020/0308921 | A1* | 10/2020 | Hrupp | E21B 43/261 |
| 2021/0071493 | A1* | 3/2021 | Hrupp | E21B 41/0078 |
| 2021/0256340 | A1* | 8/2021 | Hrupp | E21B 33/124 |
| 2022/0195831 | A1* | 6/2022 | Hrupp | E21B 34/14 |

* cited by examiner

UPHOLE END FOR A COMPRESSION-SET STRADDLE PACKER

CROSS REFERENCE TO RELATED APPLICATIONS

This is a continuation of U.S. patent application Ser. No. 17/101,377 filed Nov. 23, 2020 which was a continuation of U.S. patent application Ser. No. 16/289,805 filed Mar. 1, 2019, now U.S. Pat. No. 10,900,320 which issued on Jan. 26, 2021.

FIELD OF THE INVENTION

This invention relates in general to precision fracking systems and, in particular, to a novel uphole end for a compression-set straddle packer that can be used for cased wellbore or open hole well stimulation or remediation.

BACKGROUND OF THE INVENTION

Wellbore pressure isolation tools, commonly referred to as "straddle packers", are known and used to pressure isolate a downhole area of interest in a cased or open hydrocarbon wellbore for the purpose of what is known as focused or precision well stimulation or remediation. Straddle packers designed for this purpose are well known, but their use has been associated with operational issues that frequently render them unreliable. Most straddle packers are also complex tools that are expensive to build and maintain.

There therefore exists a need for a novel uphole end for a compression-set straddle packer that permits virtually any compression set packer to be connected to the uphole end to provide a straddle packer that will operate reliably in a downhole environment.

SUMMARY OF THE INVENTION

It is therefore an object of the invention to provide an uphole end for a compression-set straddle packer.

The invention therefore provides an uphole end for a compression-set straddle packer, comprising: a multicomponent mandrel having a work string connection end that supports a packer element, the multicomponent mandrel extending from the work string connection end to a connection joint of the uphole end, the multicomponent mandrel including a bias element push component and a bias element support component; a multicomponent sliding sleeve that surrounds the multicomponent mandrel below the work string connection end and reciprocates on the multicomponent mandrel within a limited range, the multicomponent sliding sleeve including the connection joint, an transition sleeve upper end and a transition sleeve lower end that provide a bias element chamber to house the bias element push component and the bias element support component; and a bias element supported on the bias element support component of the multicomponent mandrel between the bias element push component and a lower end of the bias element chamber, the bias element constantly resisting any movement of the multicomponent sliding sleeve with respect to the multicomponent mandrel.

The invention further provides an uphole end for a compression-set straddle packer, comprising: a multicomponent mandrel having a work string connection end that supports a packer element, the multicomponent mandrel extending from the work string connection end to a connection joint of the uphole end, a work string connection component on the work string end; an upper mandrel tube threadedly connected to the work string connection component; a mandrel flow sub connected to a downhole end of the upper mandrel tube; at least one mandrel flow sub nozzle in the mandrel flow sub; a lower mandrel tube connected to a downhole end of the mandrel flow sub; a bias element push component connected to a downhole end of the lower mandrel tube; a bias element support component connected to a downhole end of the bias element push component and a mandrel termination component connected to a downhole end of the bias element support component; a multicomponent sliding sleeve that surrounds the multicomponent mandrel below the work string connection end and reciprocates on the multicomponent mandrel within a limited range, the multicomponent sliding sleeve including an upper sliding sleeve connected to a compression bell that slides over a downhole end of a packer element sleeve of the work string connection component, the upper sliding sleeve sliding over the upper mandrel tube; a slotted sliding sleeve connected to a downhole end of the upper sliding sleeve, the slotted sliding sleeve sliding over the mandrel flow sub and having slotted sliding sleeve finger components that define slots that expose the at least one mandrel flow sub nozzle; a lower sliding sleeve connected to a downhole end of the slotted sliding sleeve; an transition sleeve upper end connected to a downhole end of the lower sliding sleeve; a transition sleeve lower end connected to a downhole end of the transition sleeve upper end, the upper and lower sliding sleeves providing a bias element chamber that houses the bias element push component and the bias element support component of the multicomponent mandrel; and the connection joint which is connected to the transition sleeve lower end; and a bias element supported on the bias element support component of the multicomponent mandrel between the bias element push component and a lower end of the bias element chamber, the bias element constantly resisting any movement of the multicomponent sliding sleeve with respect to the multicomponent mandrel.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
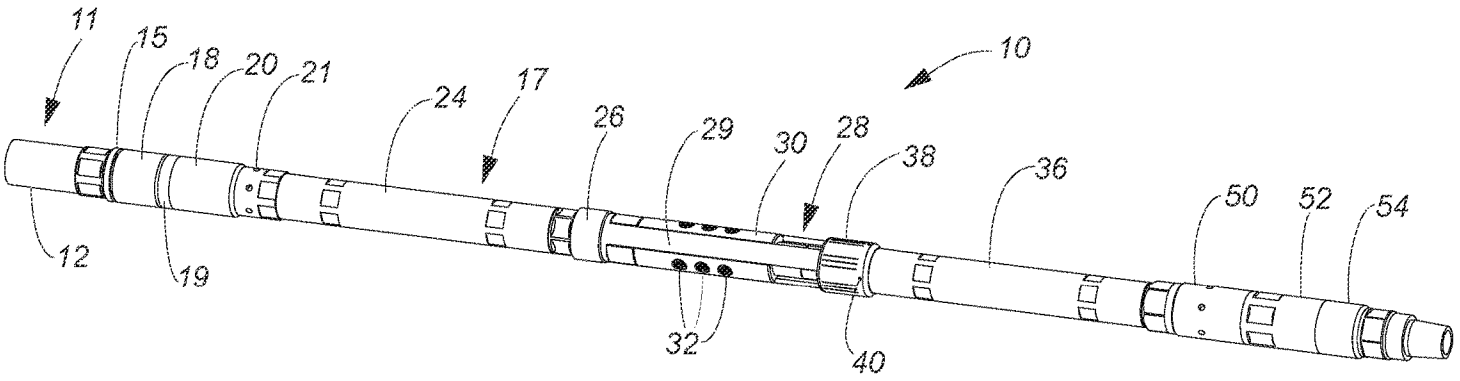
FIG. 1 is a perspective view of an embodiment of an uphole end for a compression-set straddle packer in accordance with the invention.

The invention provides an uphole end for a compression-set straddle packer. The uphole end may be connected to substantially any compression-set packer to provide a straddle packer that may be used in precision well stimulation or remediation treatments in either open hole or cased wellbores (hereinafter referred to collectively as "wellbores"). A length of a zone that is pressure isolated by the straddle packer may be adjusted, if desired, by inserting tubular extensions between a connection joint of the uphole end and the compression-set packer. The uphole end has a multicomponent mandrel that extends from an upper end to a lower end thereof. A multicomponent sliding sleeve surrounds the multicomponent mandrel and reciprocates within a limited range over the multicomponent mandrel. The multicomponent mandrel includes a mandrel flow sub component. The mandrel flow sub has at least one abrasion-resistant fluid nozzle used to inject well stimulation or well remediation fluid (hereinafter referred to collectively as "high pressure fluid") into a section of a wellbore that is pressure isolated by a packer element of the uphole end and a packer element of the connected compression-set packer when the respective packer elements are in a packer set condition. In this document, "flow sub nozzle" means any orifice, permanent or interchangeable, through which high pressure fluid may be pumped, including but not limited to a bore and a slot. In the packer set condition the respective packer elements are in high pressure sealing contact with a wellbore. The respective packer elements are compressed to the packer set condition by work string weight applied at surface to a work string connected to the uphole end. A bias element is captured between a bias element push component of the multicomponent mandrel and a lower end of a bias element chamber provided by the multicomponent sliding sleeve. The bias element constantly resists relative movement of the multicomponent mandrel with respect to the multicomponent sliding sleeve.

When the compression-set packer is being set using work string manipulation in a manner required by the compression-set packer being used, string weight overcomes the resistance of the bias element, which slides the multicomponent mandrel within the multicomponent sliding sleeve to set the packer on the uphole end and pressure isolate a section of the well bore. High-pressure fluid may then be pumped through the work string into the pressure isolated section of the well bore. When the high-pressure fluid treatment is completed and string weight is released from the work string, the bias element assists unsetting of the respective packers. In one embodiment the bias element is an elastomeric tube received on the multicomponent mandrel. In one embodiment, the multicomponent mandrel includes ports under the bias element and the bias element chamber wall includes ports above the bias element. When the packers are set, the bias element seals the respective ports in the multicomponent mandrel and the bias element chamber wall. When string weight is released from the uphole end, the bias element relaxes and opens the respective ports, which permits fluid in the multicomponent mandrel to flow around opposite ends of the bias element and into the well bore, which can facilitate recovery from a "screen-out" should one occur.

| Part No. | Part Description |
|---|---|
| 10 | Uphole end for a compression-set straddle packer |
| 11 | Multicomponent mandrel |
| 12 | Work string connection component |
| 13 | Multicomponent mandrel central passage |
| 14 | Work string connection |
| 15 | Packer element compression shoulder |
| 16 | Packer element sleeve |
| 17 | Multicomponent sliding sleeve |
| 18 | Packer element |
| 19 | Packer element compression ring |
| 20 | Compression bell |
| 21 | Compression bell pressure equalization ports |
| 22 | Upper crossover tube |
| 23 | Upper mandrel tube |
| 24 | Upper sliding sleeve |
| 25 | Upper sliding sleeve threaded connection |
| 26 | Upper sliding sleeve coupling |
| 27 | Slotted sliding sleeve female coupling end |
| 28 | Slotted sliding sleeve |
| 29 | Sliding sleeve finger components |
| 30 | Mandrel flow sub |
| 31 | Mandrel flow sub grooves |
| 32 | Mandrel flow sub nozzles |
| 34 | Lower sliding sleeve coupling |
| 36 | Lower sliding sleeve |
| 38 | Slotted sliding sleeve captured end coupling ring |
| 40 | Cap screws |
| 42 | Lower mandrel tube |
| 44 | Bias element push component |
| 46 | Bias element support component |
| 48 | Mandrel termination component |
| 50 | Transition sleeve upper end |
| 52 | Transition sleeve lower end |
| 54 | Connection joint |
| 56 | Bias element chamber |
| 58 | Bias element |
| 60 | Upper bias element push ring |
| 62 | Lower bias element push ring |
| 64 | Mandrel ports |
| 66 | Transition sleeve ports |
| 68 | Bias element uphole end |
| 70 | Bias element downhole end |
| 72 | Bias element central passage |
| 74 | Bias element outer vent groove |
| 76 | Bias element inner vent groove |
| 78 | Transition sleeve slots |
| 80 | Compression spring |

FIG. 1 is a perspective view of one embodiment of the uphole end 10 for a compression-set straddle packer (hereinafter for the sake of simplicity, simply "uphole end 10") in accordance with one embodiment of the invention. The uphole end 10 has a multicomponent mandrel 11, the majority of which can only be seen in a cross-sectional view (see FIGS. 2*a* and 2*b*). The multicomponent mandrel 11 extends completely through the uphole end 10 and is surrounded by a multicomponent sliding sleeve 17, which reciprocates within a limited range over the multicomponent mandrel 1. The multicomponent mandrel 11 includes a work string connection component 12 with a work string connection 14 (see FIG. 2*a*). A configuration of the work string connection 14 is a matter of design choice and dependent on whether the uphole end 10 is to be operated using a coil tubing string (not shown) or jointed tubing string (not shown), as is well understood in the art.

The work string connection component 12 has a packer element compression shoulder 15 and a packer element sleeve 16 (see FIG. 2*a*) that supports an elastomeric packer element 18, the function of which is well understood in the art. On a downhole side of the packer element 18 is a packer element compression ring 19 that slides on the packer element sleeve 16. A compression bell 20, having compression bell equalization ports 21, is a component of the multicomponent sliding sleeve 17 and is connected to an upper sliding sleeve 24. The upper sliding sleeve 24 is connected by an upper sliding sleeve thread connection 25 to an upper sliding sleeve coupling 26, which is in turn connected to a female coupling end 27 (see FIG. 2*b*) of a slotted sliding sleeve 28. In one embodiment, the slotted sliding sleeve 28 has three slotted sliding sleeve finger components 29 that are respectively received in mandrel flow sub grooves 31 in the mandrel flow sub 30. The slotted sliding sleeve finger components 29 define three slots that respectively expose at least one mandrel flow sub nozzle of a mandrel flow sub 30. In this embodiment, the mandrel flow sub 30 has a plurality of mandrel flow sub nozzles, 32. It should be understood the number of mandrel flow sub nozzles is a matter of design choice. A downhole end of the sliding sleeve finger components 29 are threadedly connected to a slotted sliding sleeve captured end coupling ring 38 that surrounds a lower sliding sleeve coupling 34 (see FIG. 2*a*) that is threadedly connected to a lower sliding sleeve 36. A downhole end of the lower sliding sleeve 36 is connected to a transition sleeve upper end 50 that is in turn connected to a transition sleeve lower end 52. A connection joint 54, which is the final component of the multicomponent sliding sleeve 17, is connected to a lower end of the transition sleeve lower end 52. The connection joint 54 is used to connect a compression-set packer (not shown) to the uphole end 10 to provide a straddle packer. The compression-set packer may be connected directly to the connection joint 54, or one or more extension pipes (not shown) can be connected to the connection joint 54, in which case the compression-set packer is connected to a lower end of the extension pipe(s) to increase a length of a well bore that is pressure isolated by the straddle packer.

Figure 2A:
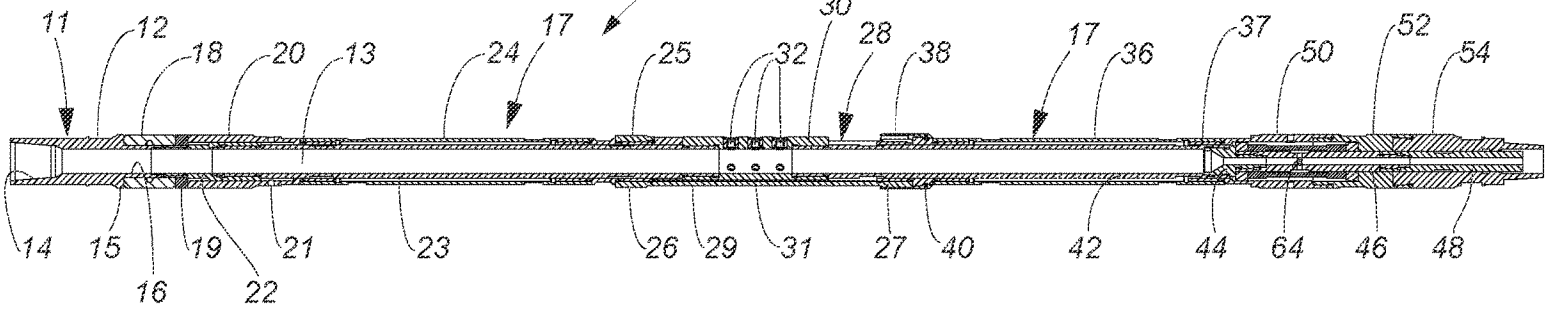
FIG. 2*a* is a cross-sectional view of the uphole end for a compression-set straddle packer shown in FIG. 1.

FIG. 2*a* is a cross-sectional view of the uphole end 10 shown in FIG. 1. As explained above, the slotted sliding sleeve 28 is connected to the lower sliding sleeve 36 by the lower sliding sleeve coupling 34, which is threadedly connected to both the slotted sliding sleeve 28 and the lower sliding sleeve 36. The slotted sliding sleeve captured end coupling ring 38 that covers the lower sliding sleeve coupling is likewise threadedly connected to the slotted sliding sleeve 28. Rotation of the slotted sliding sleeve captured end coupling ring 38 is inhibited by cap screws 40. As further explained above, the elastomeric packer element 18 is supported on the packer element sleeve 16 of the work string connection component 12 of the multicomponent mandrel 11. The multicomponent mandrel 11 has a central passage 13 that provides an uninterrupted fluid path through the multicomponent mandrel 11. The multicomponent mandrel 11 includes the following interconnected components: the work string connection component 12, which is threadedly connected to an upper crossover tube 22 (better seen in FIG. 2*b*); threadedly connected to a lower end of the upper crossover tube 22 is an upper mandrel tube 23; the mandrel flow sub 30 connected to a downhole end of upper mandrel tube 23; the wear-resistant, replaceable mandrel flow sub nozzle(s) 32; a lower mandrel tube 42 connected to a downhole end of the mandrel flow sub 30; a bias element push component 44 connected to a downhole end of the lower mandrel tube 42; a bias element support component 46 having mandrel ports 64 connected to a downhole end of the bias element push component 44; and, a mandrel termination component 48 connected to a lower end of the bias element support component 46.

Figure 2B:
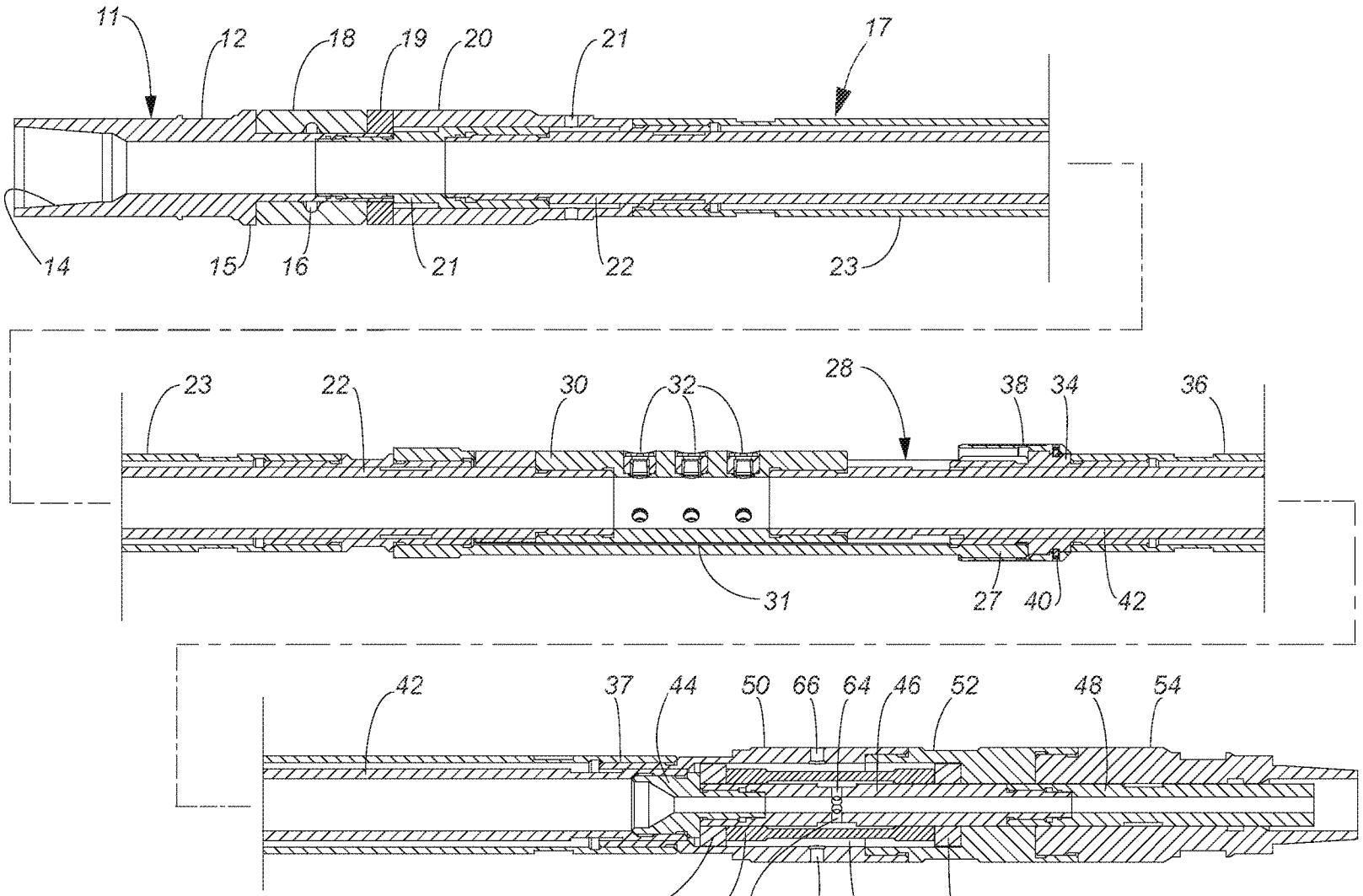
FIG. 2*b* is an enlarged cross-sectional view of the uphole end for a compression-set straddle packer shown in FIG. 2.

FIG. 2*b* is an enlarged cross-sectional view of the uphole end 10 in FIG. 2. All of the external and internal components of the uphole end 10 have been described above except for one important operative component, namely a bias element 58 housed in a bias element chamber 56 within the transition sleeve upper end 50 and the transition sleeve lower end 52 components of the multicomponent sliding sleeve 17. In one embodiment the bias element 58 is an elastomeric tube carried on the bias element support component 46. In one embodiment the tubular bias element 58 is cast from a hydrogenated nitrile butadiene rubber (HNBR) having a durometer of at least 90. An upper bias element push ring 60 abuts an upper end of the bias element 58. A lower bias element push ring 62 abuts a lower end of the bias element 58. Both the upper bias element push ring 60 and the lower bias element push ring 62 float on the bias element support component 46. The bias element 58 constantly resists any movement of the upper bias element push ring 60 toward the lower bias element push ring 62, and vice versa, thus resisting any relative movement of the multicomponent sliding sleeve 17 over the multicomponent mandrel 11. As will be explained below with reference to FIG. 3, the bias element 58 serves several important functions in the operation of the uphole end 10.

Figure 3:
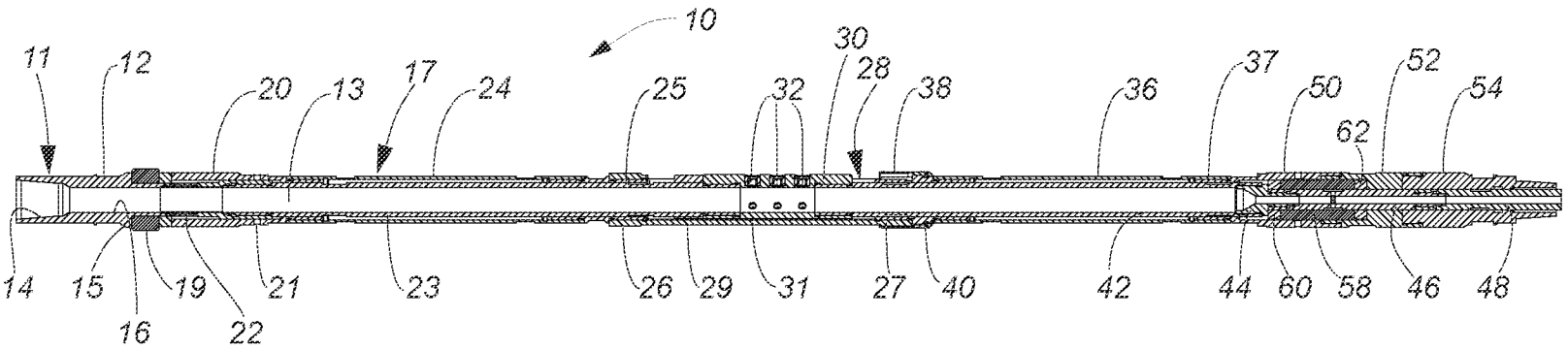
FIG. 3 is a cross-sectional view of the uphole end for a compression-set straddle packer showing the uphole end as it would appear if the straddle packer were in a packer-set condition.

FIG. 3 is a cross-sectional view of the uphole end 10 showing the uphole end 10 as it would appear if it was connected to a compression-set packer to provide a straddle packer and the straddle packer were in a packer-set condition. In the set condition the bias element 58 is compressed by work string weight applied from the surface in a manner well understood in the art. When work string weight is applied to the work string connection component 12, The multicomponent mandrel 11 is forced downhole and slides downward within the multicomponent sliding sleeve 17. This urges the bias element push component 44 and the upper bias element push ring 60 to compress the bias element 58 as the bias element support component 46 is forced downhole through the lower bias element push ring 62. The compressed bias element 58 urges the multicomponent sliding sleeve 17 downhole as the uphole end 10 is forced downhole to set the compression-set packer (not shown) in a manner well known in the art. Meanwhile, movement of the multicomponent mandrel 11 urges the packer element compression shoulder 15 against the packer element 18 to set the packer element 18. In addition, as the bias element 58 compresses under the work string weight load it increases in diameter to fill the bias element chamber 56 (see FIG. 2*b*) sealing mandrel ports 64 in the bias element support component 46 and transition sleeve ports 66 in the transition sleeve upper end 50 to prevent any escape of high-pressure fluid pumped into the uphole end 10 through the mandrel ports 64. However, if a screen-out (well understood in the art) occurs, relieving work string weight at the surface lets the bias element 58 relax as shown in FIG. 2*b*, opening the mandrel ports 64 and providing a fluid path around opposed ends of the relaxed bias element 58 and out through the transition sleeve ports 66 to permit high-pressure fluid trapped in the uphole end 10 to drain into an annulus of the well bore. The bias element 58 also assists the return of the uphole end 10 to the run-in position after string weight is removed from the work string, and prevents premature setting of the packer element 18 in the event a minor obstruction is tagged in the well bore while the straddle packer is being run into the well bore.

Figure 4:
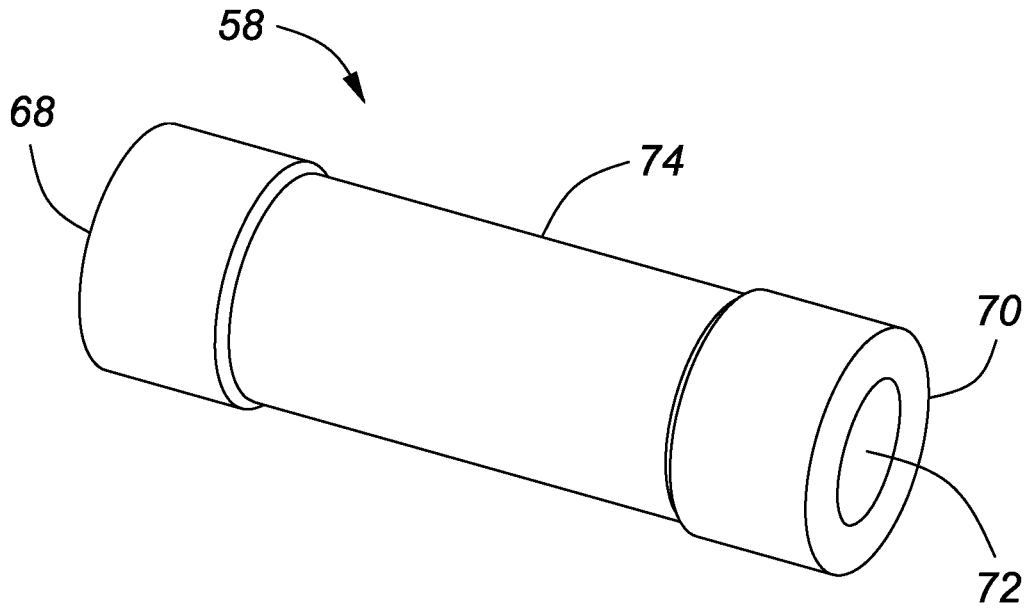
FIG. 4 is a perspective view of one embodiment of a bias element of the uphole end for a compression-set straddle packer in accordance with the invention.
Figure 5:
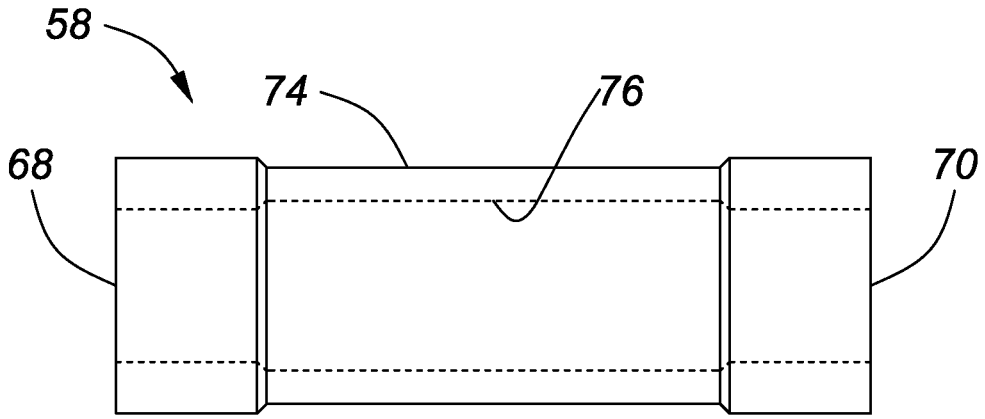
FIG. 5 is a side elevational view of the bias element shown in FIG. 4.

FIG. 4 is a perspective view of one embodiment of a bias element 58 of the uphole end 10 in accordance with the invention. In this embodiment, the bias element 58 has a bias element uphole end 68 and a bias element downhole end 70. However, the bias element 58 is symmetrical and may be inserted with either end uphole. A wide external bias element outer vent groove 74 and a corresponding bias element inner vent groove 76 (see FIG. 5) ensure that the mandrel ports 64 and the transition sleeve ports 66 remain open when the bias element 58 is in a relaxed condition. A bias element central passage 72 is sized to accept the bias element support component 46 of the multicomponent mandrel 11. FIG. 5 is a side elevational view of the bias element 58 shown in FIG. 4.

Figure 6:
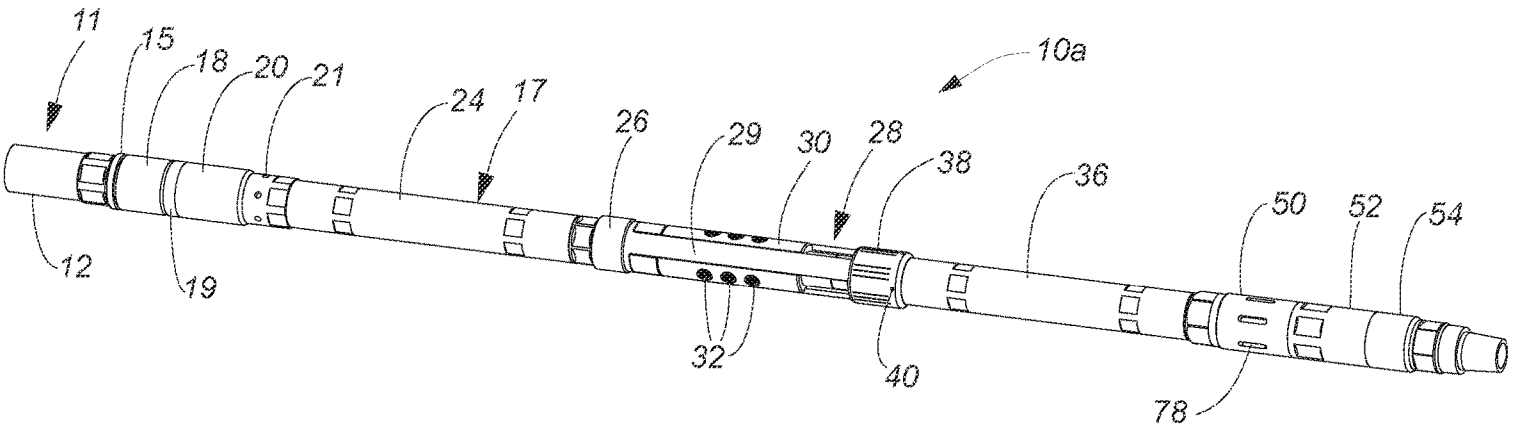
FIG. 6 is a perspective view of another embodiment of the uphole end for a compression-set straddle packer in accordance with the invention.
Figure 7:
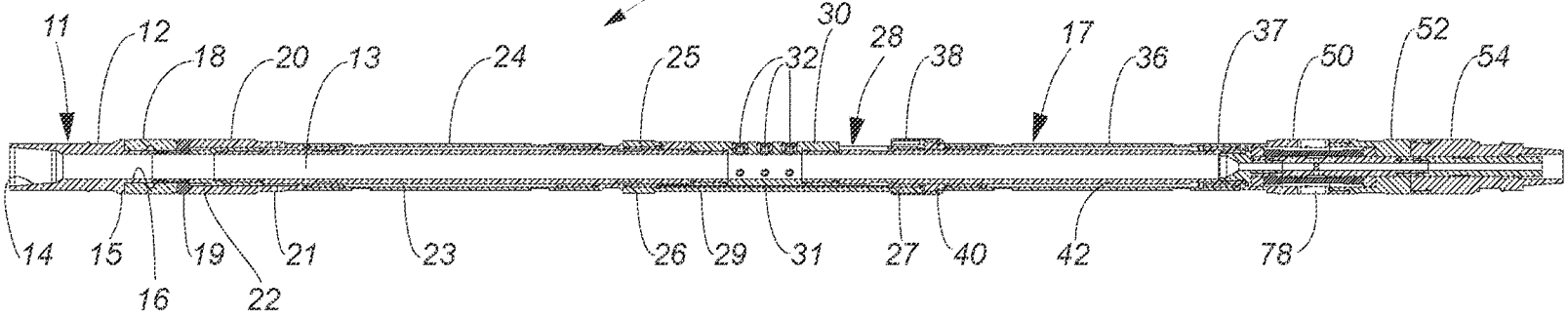
FIG. 7 is a cross-sectional view the embodiment of the uphole end shown in FIG. 6.

FIG. 6 is a perspective view of another embodiment of an uphole end 10*a* for a compression-set straddle packer in accordance with the invention. This embodiment of the uphole end 10*a* has all of the components and features of the uphole end described above with reference to FIGS. 1-5 with an exception that the ports in the transition sleeve upper end 50 are elongated transition sleeve slots 78 to encourage fluid egress in an event that a screen out occurs when fluid heavily laden with proppant is being pumped through the uphole end 10*a*. FIG. 7 is a cross-sectional view the embodiment of the uphole end 10*a* shown in FIG. 6.

Figure 8:
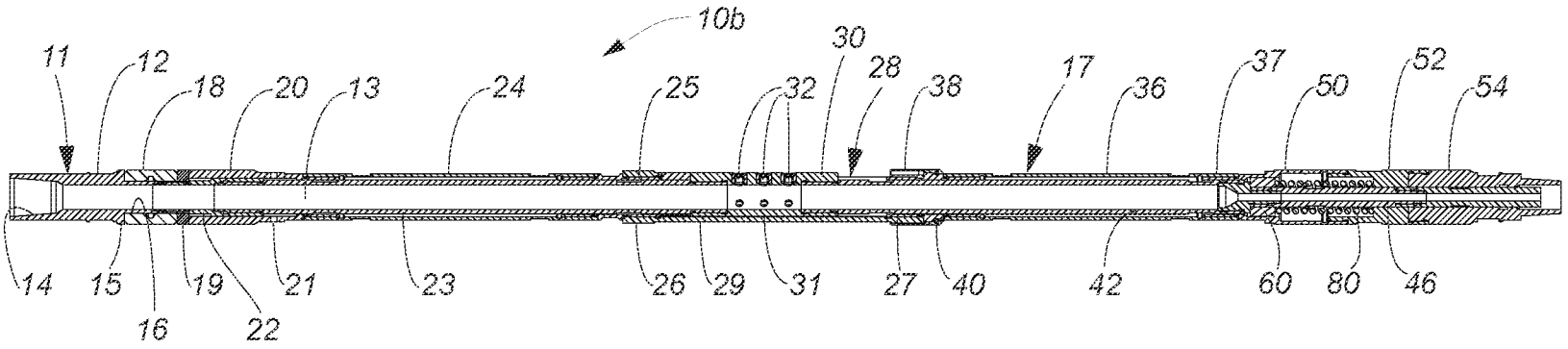
FIG. 8 is a cross-sectional view a further embodiment of the uphole end for a compression-set straddle packer in accordance with the invention.

FIG. 8 is a cross-sectional view a further embodiment of an uphole end 10*b* for a compression-set straddle packer in accordance with the invention. All of the components and features of the uphole end 10*b* have been described above with reference to FIGS. 1-5 except that the bias element in the uphole end 10 is a bias element compression spring 80. The uphole end 10*b* also has only the upper bias element push ring 60, and the bias element support component 46 has no ports. Furthermore, there are no ports in the transition sleeve upper end 50. In one embodiment of the uphole end 10*b*, the bias element compression spring 80 is preloaded with about 2,000 pounds of compression when the uphole end 10*b* is assembled, and maintains that tension in an unset condition of the uphole end 10*b*. The uphole end 10*b* is operated in the same manner as described above with reference to the uphole end 10.

The explicit embodiments of the invention described above have been presented by way of example only. The scope of the invention is therefore intended to be limited solely by the scope of the appended claims.

I claim:

1. An uphole end for a compression-set straddle packer, comprising:

a multicomponent mandrel having a work string connection end that supports a packer element, the multicomponent mandrel extending through the uphole end;

a multicomponent sliding sleeve that surrounds the multicomponent mandrel below the packer element and reciprocates on the multicomponent mandrel within a limited range, a downhole end of the multicomponent sliding sleeve comprising a connection joint adapted to provide a connection for a compression-set packer to provide a straddle packer;

a bias element supported on the multicomponent mandrel between a bias element push component of the multicomponent mandrel and a downhole end of a bias element chamber of the multicomponent sliding sleeve, the bias element constantly resisting reciprocation of the multicomponent sliding sleeve on the multicomponent mandrel.

2. The uphole end as claimed in claim 1 wherein a downhole end of the work string connection end is threadedly connected to an upper mandrel tube.

3. The uphole end as claimed in claim 2 wherein a downhole end of the upper mandrel tube is connected to a mandrel flow sub having at least one mandrel flow sub nozzle.

4. The uphole end as claimed in claim 3 wherein a downhole end of the mandrel flow sub is connected to a lower mandrel tube.

5. The uphole end as claimed in claim 4 wherein a downhole end of the lower mandrel tube is connected to the bias element push component.

6. The uphole end as claimed in claim 5 wherein a bias element support component that supports the bias element is connected to a downhole end of the bias element push component, the bias element support component comprising one of ports and slots in fluid communication with a central passage of the multicomponent mandrel.

7. The uphole end as claimed in claim 6 wherein the multicomponent mandrel further comprises a mandrel termination component connected to a downhole end of the bias element support component.

8. The uphole end as claimed in claim 7 wherein the multicomponent sliding sleeve comprises a compression bell that slides over a downhole end of a packer element sleeve of the work string connection component.

9. The uphole end as claimed in claim 8, wherein the multicomponent sliding sleeve further comprises an upper sliding sleeve supported on the upper mandrel tube.

10. The uphole end as claimed in claim 9 wherein the multicomponent sliding sleeve further comprises a slotted sliding sleeve connected to a downhole end of the upper sliding sleeve, the slotted sliding sleeve sliding over the mandrel flow sub and exposing the at least one mandrel flow sub nozzle.

11. The uphole end as claimed in claim 10 wherein the multicomponent mandrel further comprises a lower sliding sleeve connected to a downhole end of the slotted sliding sleeve.

12. The uphole end as claimed in claim 11 wherein the multicomponent mandrel further comprises a transition sleeve connected to a downhole end of the lower sliding sleeve the transition sleeve defining the bias element chamber, which comprises one of ports and slots that provide fluid communication between the bias element chamber and an exterior of the transition sleeve.

13. The uphole end as claimed in claim 12 wherein the multicomponent sliding sleeve further comprises the connection joint is connected to a downhole end of the transition sleeve.

14. The uphole end as claimed in claim 1 wherein the bias element comprises an elastomeric tube.

15. The uphole end as claimed in claim 1 wherein the bias element comprises a compression spring under preload compression.

16. An uphole end for a compression-set straddle packer, comprising:

a multicomponent mandrel having with a work string connection and a packer element support component that supports a packer element on one end, the multicomponent mandrel extending through the uphole end;

a multicomponent sliding sleeve that surrounds the multicomponent mandrel below the packer element and reciprocates on the multicomponent mandrel from a run-in position to a packer set condition and includes an end opposite the one end with a connection joint adapted to provide a connection of a compression- set packer to provide a straddle packer; and a bias element that constantly resists the reciprocation of the multicomponent sliding sleeve on the multicomponent mandrel.

17. The uphole end as claimed in claim 16 wherein the bias element comprises an elastomeric tube.

18. The uphole end as claimed in claim 16 wherein the bias element comprises a coil spring under pre-load compression.

19. An uphole end for a compression set packer comprising a multicomponent mandrel having a work string connection end that supports a packer element and a multicomponent sliding sleeve that reciprocates on the multicomponent mandrel below the packer element, the multicomponent sliding sleeve housing a bias element supported on the multicomponent mandrel, the bias element constantly resisting reciprocation of the multicomponent sliding sleeve on the multicomponent mandrel, and the multicomponent sliding sleeve further comprises a connection joint adapted to provide a connection for a compression-set packer to provide a straddle packer.

20. The uphole end as claimed in claim 19 wherein the bias element comprises one of an elastomeric tube and a compression spring under pre-load compression.

* * * * *